United States Patent [19]

Weinand

[11] Patent Number: 4,601,275

[45] Date of Patent: Jul. 22, 1986

[54] FUEL RAIL

[75] Inventor: Louis H. Weinand, Troy, Mich.

[73] Assignee: General Motors Corporation, Detroit, Mich.

[21] Appl. No.: 410,611

[22] Filed: Aug. 23, 1982

[51] Int. Cl.[4] ..... F02M 39/00

[52] U.S. Cl. ..... 123/468; 123/514; 123/516; 123/456; 137/883; 165/142; 138/95

[58] Field of Search ..... 123/468, 469, 470, 471, 123/472, 456, 514, 516; 137/883, 884, 269, 271; 165/142; 138/92, 95, 115

[56] References Cited

U.S. PATENT DOCUMENTS

| | | | |
|---|---|---|---|
| 1,946,945 | 2/1934 | Merler | 138/95 |
| 2,166,331 | 7/1939 | Waeber | 123/470 |
| 2,663,325 | 12/1953 | Bede | 138/115 |
| 2,669,435 | 2/1954 | Cord | 165/142 |
| 2,706,620 | 4/1955 | Graves | 165/142 |
| 3,783,844 | 1/1974 | Goral | 123/469 |
| 3,785,354 | 1/1974 | Moulds | 123/468 |
| 3,788,287 | 1/1974 | Falen | 123/468 |
| 3,789,819 | 2/1974 | Moulds | 123/469 |
| 3,845,748 | 11/1974 | Eisenberg | 123/469 |
| 4,241,193 | 12/1980 | Bowler | 123/516 |
| 4,286,563 | 9/1981 | Fahim | 123/469 |
| 4,341,193 | 7/1982 | Bowler | 123/516 |
| 4,395,988 | 8/1983 | Knapp | 123/469 |

FOREIGN PATENT DOCUMENTS

| | | | |
|---|---|---|---|
| 3132432 | 2/1983 | Fed. Rep. of Germany | 123/468 |
| 3228508 | 2/1984 | Fed. Rep. of Germany | 123/472 |
| 854677 | 11/1960 | United Kingdom | 123/469 |
| 2073316 | 5/1983 | United Kingdom | 123/468 |

OTHER PUBLICATIONS

Robert Bosch GmbH, "Technische Unterrichtung", L-Jetronic, Federal Republic of Germany, Apr. 1981.

*Primary Examiner*—Carl Stuart Miller
*Attorney, Agent, or Firm*—C. K. Veenstra

[57] ABSTRACT

A fuel rail containing injectors for delivering fuel to an engine has a large passage supplying fuel to the injectors and a small fuel return passage. The injectors are received in sockets each of which has a restricted vent extending to the return passage. The fuel rail is formed by molding or extruding a body with the supply and return passages, and a single circular plug at one end provides a closure for the associated ends of both the supply and return passages.

1 Claim, 3 Drawing Figures

FUEL RAIL

TECHNICAL FIELD

This invention provides an improved fuel rail which supports injectors for delivering fuel to an engine.

BACKGROUND

Some fuel injection systems for automotive engines have a plurality of fuel injectors each of which delivers fuel to the inlet port of an associated engine combustion chamber. In some such systems, the fuel injectors are mounted in sockets of a fuel rail which has a passage to supply fuel to the injectors; the fuel rail simplifies installation of the fuel injectors and the fuel supply passage on the engine.

When electromagnetic injectors are employed in such a system, the injectors deliver fuel to the engine in pulses which are timed to control the amount of fuel delivered. The duration of the fuel pulses is calculated to deliver the proper amount of fuel in liquid form, and the fuel system must assure that the fuel injectors receive only liquid fuel; if fuel vapor is entrained in the fuel supplied to the injectors, the fuel pulses will not contain the required amount of fuel.

It has been recognized, of course, that formation of fuel vapor in a fuel supply passage is related to the pressure and temperature of the fuel—the same amount of fuel vapor that would form at a fuel temperature of 185° C. and pressure of 269 kPa would form at a fuel temperature of 155° C. and pressure of 97 kPa. Thus in prior systems of this nature, formation of fuel vapor was inhibited by supplying the fuel to the injectors at a pressure of at least about 269 kPa, and a high pressure fuel supply pump was required.

SUMMARY OF THE INVENTION

This invention provides an improved fuel rail suitable for delivering fuel to an automotive engine. This improved fuel rail assures that fuel vapor which might be formed in the fuel supply passage is separated from the liquid fuel. With this improved fuel rail, fuel may be supplied to the injectors at a pressure as low as 97 kPa without entraining fuel vapor in the liquid fuel supplied to the injectors, and the expense of a high pressure fuel supply pump may be avoided.

In a fuel rail according to this invention, a plurality of fuel injector sockets are provided to receive the fuel injectors and a large fuel passage intersects the injector sockets. The fuel passage supplies fuel to the injector sockets, and the injectors deliver fuel from the lower portion of the sockets to the engine. The large fuel supply passage effectively minimizes the velocity and turbulence of the fuel flow in the fuel supply passsage to allow adequate separation of fuel vapor from the liquid fuel to be delivered by the injectors.

A fuel rail according to this invention also may include an additional feature allowing fuel vapor which accumulates in the fuel supply passage to be discharged directly to a parallel excess fuel return passage. In the preferred embodiment of this fuel rail, the upper portion of each of the injector sockets has a restricted vent extending to the return passage; the vents allow fuel vapor accumulating in the supply passage and the injector sockets to be discharged directly to the return passage and also allow circulation of fuel through the injector sockets to cool the injectors.

A fuel rail according to this invention may be molded with parallel fuel supply and return passages. As another feature of the preferred embodiment of this fuel rail, one end of the fuel rail has a circular recess intersected by and encompassing the associated ends of the fuel passages, and a circular plug is received in and seals the recess to provide a single closure for the associated ends of both fuel passages.

The details of the preferred embodiment as well as other features and advantages of this invention are set forth in the remainder of the specification and are shown in the accompanying drawing.

THE PREFERRED EMBODIMENT

Figure 1:
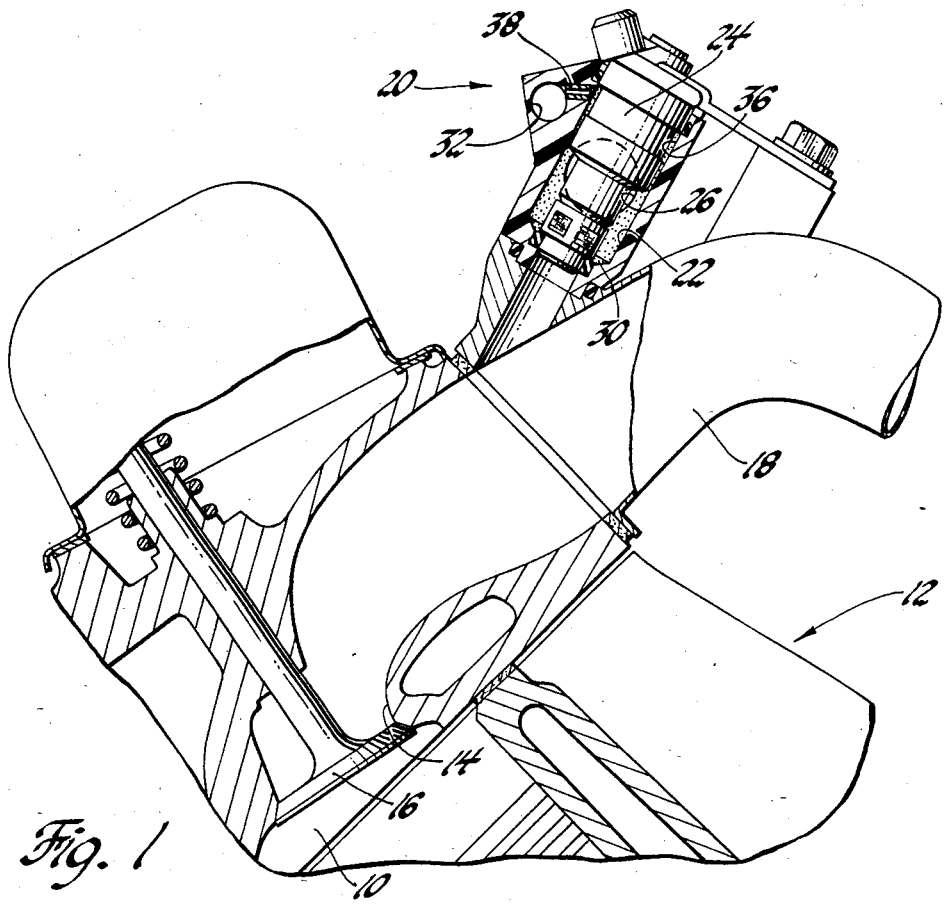
FIG. 1 is a schematic sectional view of a portion of an engine showing a fuel rail according to this invention mounted on an engine inlet manifold adjacent the engine combustion chamber inlet ports, the section through the fuel rail being taken along line 1—1 of FIG. 2.
Figure 2:
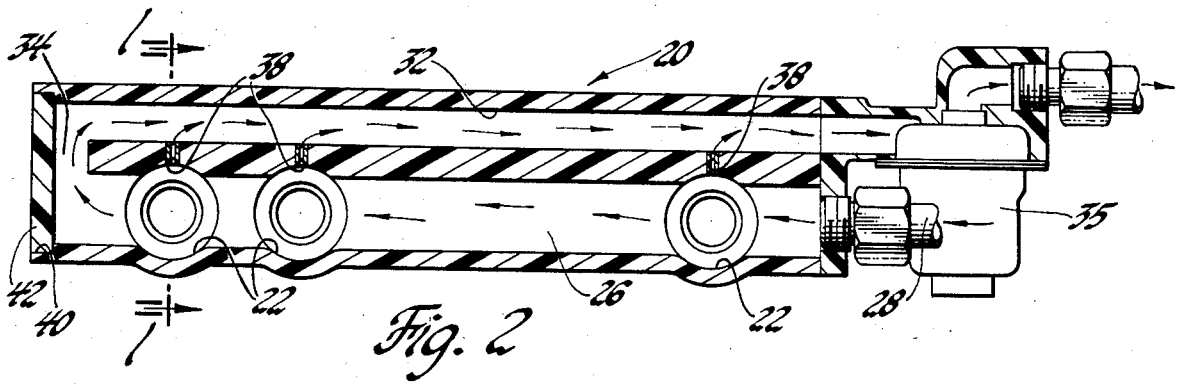
FIG. 2 is a sectional view of the fuel rail showing the layout of its fuel supply and return passages and its injector sockets.
Figure 3:
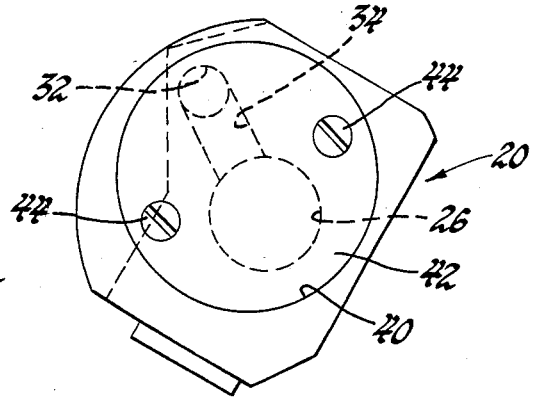
FIG. 3 is an end view of the fuel rail showing the plug which seals the fuel passages.

Referring to the drawing, each combustion chamber 10 of an automotive spark ignition engine 12 receives a mixture of air and fuel through an inlet port 14 controlled by an inlet valve 16. Inlet port 14 receives air from an inlet manifold 18 and fuel from a fuel rail 20.

Fuel rail 20 has a plurality of fuel injector sockets 22 each of which contains a fuel injector 24. A fuel supply passage 26 receives fuel through a fuel line 28 from a low pressure fuel supply pump (not shown). Passage 26 intersects each of the sockets 22 to supply fuel to sockets 22, and each injector 24 delivers fuel from the lower portion 30 of its socket 22 into its associated engine inlet port 14.

Fuel injectors 24 preferably are conventional electromagnetic fuel injectors energized by a conventional electronic control unit (not shown) to deliver timed pulses of fuel for mixture with the air which flows into combustion chamber 10 through inlet port 14.

Fuel rail 20 also has a fuel return passage 32 parallel to supply passage 26. Return passage 32 is connected to supply passage 26 by a channel 34 at the left hand end of fuel rail 20 and discharges fuel through a pressure regulator 35. Return passage 32 has approximately the same fuel flow area as fuel line 28, but supply passage 26 has a fuel flow area substantially greater than the fuel flow area of fuel line 28 and return passage 32. The substantially greater fuel flow area of supply passage 26 effectively minimizes the velocity and turbulence of fuel flow in supply passage 26, allowing fuel vapor to separate from the liquid fuel in supply passage 26. The fuel vapor, of course, accumulates along the top of supply passage 26, and the lower portion 30 of injector sockets 22 is filled with liquid fuel to assure that injectors 24 receive only liquid fuel for delivery to engine 12.

In addition, the upper portion 36 of each injector socket 22 has a restricted vent 38 extending to return passage 32. Vents 38 allow fuel vapor accumulating in supply passage 26 and injector sockets 22 to be discharged directly to return passage 32. Vents 38 thus assure that little, if any, fuel vapor is reentrained in the liquid fuel flowing through supply passage 26 from one injector socket to another. Vents 38 also allow liquid fuel to circulate through injector sockets 22 to cool injectors 24.

The left hand end of fuel rail 20 has a circular recess 40 which encompasses the associated ends of supply passage 26 and return passage 32. A circular plug 42 is received in and seals recess 40 and provides a single closure for the associated ends of both supply passage 26 and return passage 32.

The fuel rail shown in the drawing is molded of plastic, and plug 42 may be secured in recess 40 by any satisfactory technique such as bolts 44.

It will be appreciated that each of the various features of the fuel rail depicted here may be used without employing all of the remaining features. In combination, however, they provide a fuel rail of particularly advantageous construction.

The embodiments of the invention in which an exclusive property or privilege is claimed are defined as follows:

1. A fuel rail for an engine, said rail comprising an elongated body having a plurality of axially spaced transversely extending fuel injector sockets and a pair of transversely spaced axially extending fuel passages, said fuel passages being interconnected at one end of said body for fuel flow through said passages in series, one of said passages intersecting said sockets for supplying fuel to said sockets, each of said sockets being adapted to receive a fuel injector suitable for delivering fuel from its socket to the engine, and wherein at least one end of said body has a circular recess intersected by and encompassing the associated ends of said fuel passages, and a circular plug is received in and seals said recess to provide a closure for the associated ends of both of said passages.

* * * * *